United States Patent [19]

McClincy et al.

[11] Patent Number: 4,602,947

[45] Date of Patent: Jul. 29, 1986

[54] PROCESS FOR PRODUCING TITANIUM METAL AND TITANIUM METAL ALLOYS

[75] Inventors: Richard J. McClincy; Robert W. Bartlett; Mickey J. Lawler; Rolf J. Wesely, all of Tucson, Ariz.

[73] Assignee: Alti Corporation, Albany, Oreg.

[21] Appl. No.: 667,305

[22] Filed: Nov. 1, 1984

[51] Int. Cl.[4] ..... B22F 9/00

[52] U.S. Cl. ..... 75/0.5 BB; 75/0.5 C; 75/84.4; 75/84.5; 264/12

[58] Field of Search ..... 75/0.5 C, 0.5 BB, 84.4, 75/84.5; 264/12

[56] References Cited

U.S. PATENT DOCUMENTS

| | | | |
|---|---|---|---|
| 2,984,560 | 5/1961 | Dombrowski | 75/0.5 BB |
| 4,468,248 | 8/1984 | Megy | 75/84.4 |
| 4,470,847 | 9/1984 | Hard et al. | 75/0.5 BB |
| 4,477,277 | 10/1984 | D'Altilia et al. | 75/0.5 BB |
| 4,484,943 | 11/1984 | Miura et al. | 75/0.5 C |

*Primary Examiner*—Wayland Stallard

*Attorney, Agent, or Firm*—Christie, Parker & Hale

[57] ABSTRACT

A process for producing titanium metal in finely-divided particulate form, by forming a liquid mixture of titanium and zinc, fracturing and solidifying the liquid mixture and evaporating zinc from the resulting finely-divided particles to produce finely divided particulate titanium. Titanium alloys may be produced by adding an alloying metal or metals to the liquid titanium-zinc mixture prior to fracturing, solidification and zinc evaporation. The liquid mixture of titanium and zinc may be produced by reaction of a reducing metal in a liquid mixture of zinc and reducing metal with titanium tetrachloride to produce reducing metal chloride and a liquid mixture of titanium and zinc. The reducing metal chloride is separated from the mixture of titanium and zinc. The alloying metal may be added to the liquid mixture of titanium and zinc by reacting alloying metal chlorides with the reducing metals in the liquid mixture of zinc and reducing metal. Sponge titanium or titanium alloys may be produced by omitting the fracturing and solidification step.

39 Claims, 4 Drawing Figures

PROCESS FOR PRODUCING TITANIUM METAL AND TITANIUM METAL ALLOYS

This invention relates to a process for the production of finely divided particulate titanium and titanium alloys.

This invention further relates to the production of titanium and titanium alloys from titanium tetrachloride.

This invention further relates to the production of finely divided particulate titanium and titanium alloys from titanium tetrachloride.

While titanium is readily produced in its tetrachloride form by chlorination of naturally occurring ores, wherein the titanium occurs as an oxide, either alone or in combination with other metal oxides, the conversion of the titanium tetrachloride to titanium metal and titanium alloy powders free of chloride contamination has been difficult and expensive. Previously, titanium tetrachloride was converted into titanium metal by processes such as the Kroll Process, which involves the reaction of magnesium with titanium tetrachloride to produce an impure sponge form of titanium metal which is frequently contaminated with magnesium chloride and unreacted magnesium metal. This process has required extensive further purification steps to yield titanium metal in pure form. The Hunter Process has also been used to produce titanium metal from titanium tetrachloride and involves the reaction of titanium tetrachloride with sodium to produce an impure sponge form of titanium metal which is frequently contaminated with sodium chloride and unreacted sodium metal. Methods similar to those used following the Kroll Process are required to produce titanium in pure form. To convert pure titanium sponge to titanium alloys in powder form, additional complicated and expensive steps are required to blend, consolidate and melt the titanium alloy components, followed by appropriate means to fracture the resulting titanium alloy to produce titanium alloy powders. Techniques which successfully produce clean high-quality titanium alloy powders comprise a series of variations of rotating electrode processes in which a precision machined bar of titanium alloy is rapidly rotated about its longitudinal axis in a tightly sealed container maintained under vacuum or a pressure of a suitable inert gas. One extremity of the rotating bar is melted, which results in small droplets of liquid metal being ejected from the surface of the bar by a centrifugal force. As the resultant droplets solidify in flight, powder particles are formed and collected in a suitable container. Melting of the rotating bar may be accomplished by various means such as by tungsten arc, plasma torch, and electron beam. Titanium alloy powders produced by these means are unusually clean because the titanium alloy is not in contact with any container material or supporting substrate while it is at high temperature and in the liquid state. Titanium powder may also be produced by such processes. Unfortunately, the production of titanium and titanium alloy powders by such processes is quite expensive.

In view of the difficulty of obtaining pure titanium and titanium alloy in powder form by existing processes, a continuing effort has been directed to the development of improved processes for the production of titanium metal and titanium alloys, and titanium metal in powder form and titanium alloys in powder form.

It has now been found that titanium metal is readily produced in the form of finely divided particles by a process comprising:

(a) Forming a liquid mixture of titanium and zinc;

(b) Fracturing and solidifying the liquid mixture of titanium and zinc to produce finely divided particles of said mixture; and (c) Evaporatively separating the zinc from the finely divided particles to produce finely divided particles of titanium.

This process is readily adapted to the production of finely divided particles of titanium alloys by including at least one alloying metal in the liquid mixture of titanium and zinc and thereafter processing the liquid mixture as discussed in conjunction with titanium.

In a variation of the process discussed above, the liquid mixture of titanium and zinc may be produced by reacting a liquid mixture of zinc and a reducing metal selected from the group consisting of sodium, magnesium, potassium, lithium, calcium, and mixtures thereof, with titanium tetrachloride to produce reducing metal chloride and a mixture of titanium and zinc. At least a major portion of the reducing metal chloride is then separated from the liquid mixture of titanium and zinc which may be further processed by evaporation of the zinc to produce sponge titanium or by the use of fracturing and solidification as discussed above to produce finely divided particles of titanium.

In a further variation of the process of the present invention, at least one alloying metal is added to the liquid mixture of zinc and titanium produced by the reduction of titanium tetrachloride to produce a liquid mixture of alloying metal, titanium and zinc, which is then processed as discussed above to produce either sponge titanium alloy or finely divided particulate titanium alloy.

In a further variation of the process of the present invention, at least one alloying metal in the form of its corresponding metal chloride, may be charged to the reaction zone with the titanium tetrachloride for reaction in the liquid mixture of zinc and reducing metal to produce a liquid mixture of titanium, alloying metal and zinc as the product stream from the reaction zone.

In the discussion of the Figures, the same numbers will be used to refer to the same or similar components in all instances.

As discussed previously, while titanium metal and titanium alloys are desirable in many applications for their unique properties, the production of pure titanium metal and pure titanium alloys has been almost prohibitively expensive and, as a result, the use of titanium and titanium alloys has been limited by their cost. By the process of the present invention, titanium is readily produced more economically in both its metal and its alloy forms. Since in many applications the production of component parts from titanium or titanium alloys is facilitated by the use of powder metallurgy techniques, it is highly desirable that titanium and titanium alloys be available in finely divided particulate or powder form.

Figure 1:
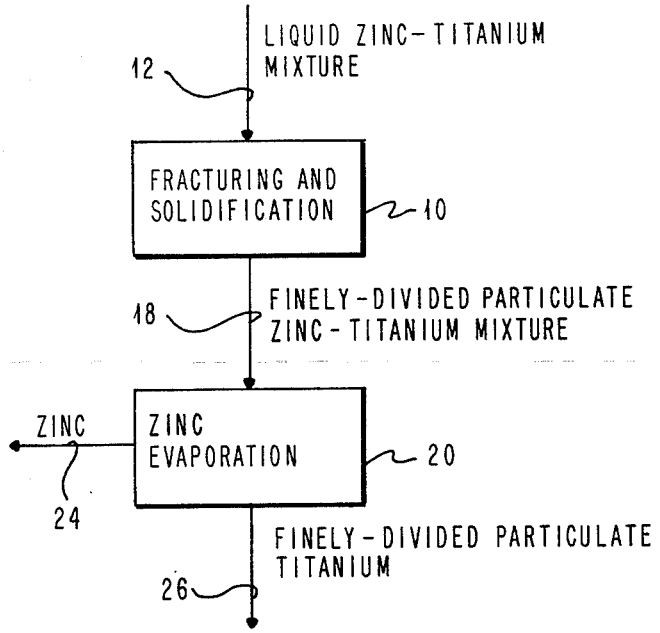
FIG. 1 is a schematic diagram of an embodiment of the present invention for the production of finely divided particulate titanium.

In FIG. 1, a liquid zinc-titanium mixture is charged through a line 12 to a fracturing and solidification zone 10. A finely divided particulate zinc-titanium mixture is recovered from zone 10, via a line 18, and passed to a zinc evaporation zone 20 through a line 24. Vaporous zinc is recovered from zinc evaporation zone 20 with finely divided particulate titanium being recovered from zone 20 through a line 26.

The liquid zinc-titanium mixture can be formed by a variety of techniques known to those skilled in the art. For instance, commercially available sponge titanium can be mixed with zinc, either in molten form or in solid form followed by heating, to produce the liquid mixture of zinc and titanium. Further, suitable liquid zinc-titanium mixtures can be produced by the reaction of titanium tetrachloride with a reducing metal, such as magnesium, in a liquid mixture of zinc and reducing metal to produce liquid zinc-titanium mixtures. Such processes will be discussed more fully hereinafter.

In fracturing and solidification zone 10, the liquid mixture of zinc and titanium is finely divided and cooled while finely divided, or otherwise comminuted to produce finely divided particles. One method for fracturing and solidifying the liquid mixture of zinc and titanium is inert gas atomization, wherein the liquid mixture is dispersed as droplets by inert gas and wherein it cools and solidifies as it falls through the gas zone into a suitable container. The liquid mixture of zinc and titanium can also be fractured by the use of shotting towers and the like. In such shotting towers the liquid mixture is made to flow through a perforated grate so that the liquid falls from the bottom of the grate in droplets, which cool and solidify as they fall through an inert gas or the like to produce pellets or shot (herein shotting). Such pellets or shot may be too large for some powder metallurgy applications, and in such instances it may be desirable to further comminute such pellets or shot to obtain smaller particles prior to the evaporation of the zinc from the pellets, shot, or comminuted particles. In a still further variation, the liquid mixture of zinc and titanium can be cooled into large chunks or ingots for suitable comminution to produce particles of a desired size. In all such operations, the comminution of the solidified mixture is facilitated as a result of the brittleness of the mixture of the zinc and titanium. Frequently, the titanium in such mixtures is no more than about 10 to about 25 wt % of the mixture with titanium contents in the neighborhood of 8 to 15 wt % being more common. The lower titanium contents are preferred, at least in part, because it permits the handling of the liquid mixture at a lower temperature since higher titanium contents require a higher temperature to maintain the mixture in a liquid form. As a result of the mixture of the titanium with the zinc, the solid mixture is much more readily handled for purposes of comminution and the like, since it is much less prone to oxidation and other chemical reactions because it is much less reactive chemically than pure titanium.

After the liquid zinc-titanium mixture has been fractured and solidified and, if desirable, comminuted to a smaller particle size, it is passed to zinc evaporation zone 20. In zinc evaporation zone 20, a suitable temperature is maintained to sublime or evaporate zinc from the finely divided particles. Final temperatures from about 800° to about 1000° C. are suitable for the evaporation of zinc in evaporation zone 20. Upon evaporation of the zinc, finely divided particles of titanium are recovered. While not shown in FIG. 1, the zinc vapor is normally passed to a zinc condensation zone and recovered for recycle to the process.

Figure 2:
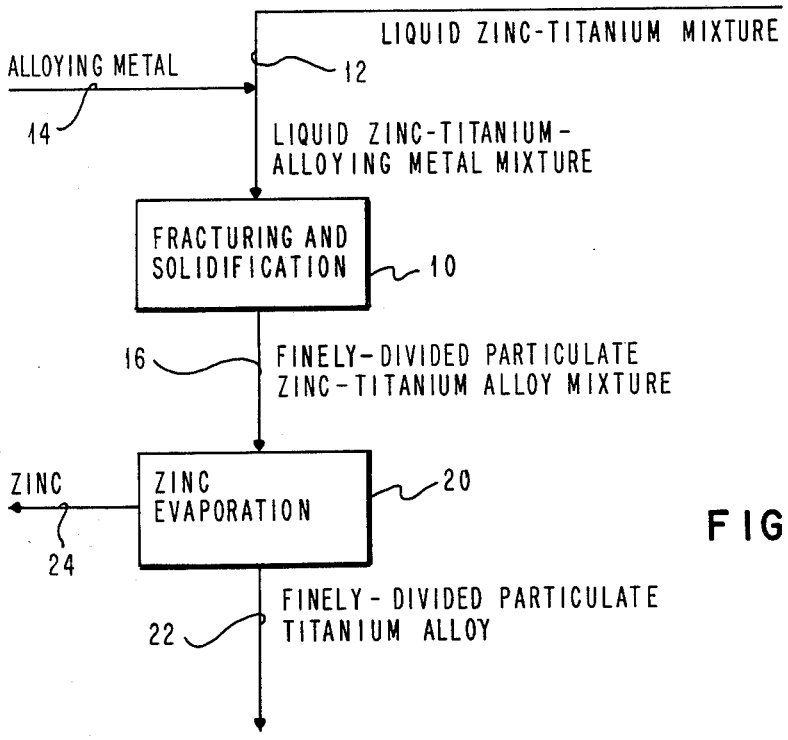
FIG. 2 is a schematic diagram of an embodiment of the process of the present invention for the production of finely divided particulate titanium alloy.

In FIG. 2, a similar process is shown with the principal difference being the use of at least one alloying metal to produce finely divided particulate titanium alloys. An alloying metal, or metals, such as vanadium, aluminum, molybdenum, tin, chromium, zirconium, columbium, tantalum, iron, mixtures thereof, and the like, is added through a line 14 to the liquid zinc-titanium mixture in line 12. The alloying metal, metals or mixture of metals, may be added in either solid or particulate form so long as the resulting liquid zinc-titanium-alloying metal mixture is suitably liquid. Suitable liquification may be accomplished by charging the alloying metals as solids for subsequent melting, or in molten form, by superheating the liquid mixture of zinc and titanium, the use of a heating zone, or the like. Such variations are considered to be well-known to those skilled in the art. Suitable alloying metals are substantially any metal which is metallurgically compatible with the zinc-titanium mixture and which forms a desirable alloy with titanium. Some widley used alloying metals are vanadium and aluminum, which are frequently used in combination. A commonly used alloying range for these metals in combination is from about 1 to about 15 wt % vanadium and from about 1 to about 15 wt % aluminum in the titanium alloy. After the formation of the liquid zinc-titanium-alloying metal mixture, the processing steps carried out in fracturing and solidification vessel 10 and in zinc evaporation vessel 20 are substantially the same as those discussed in conjunction with FIG. 1.

Figure 3:
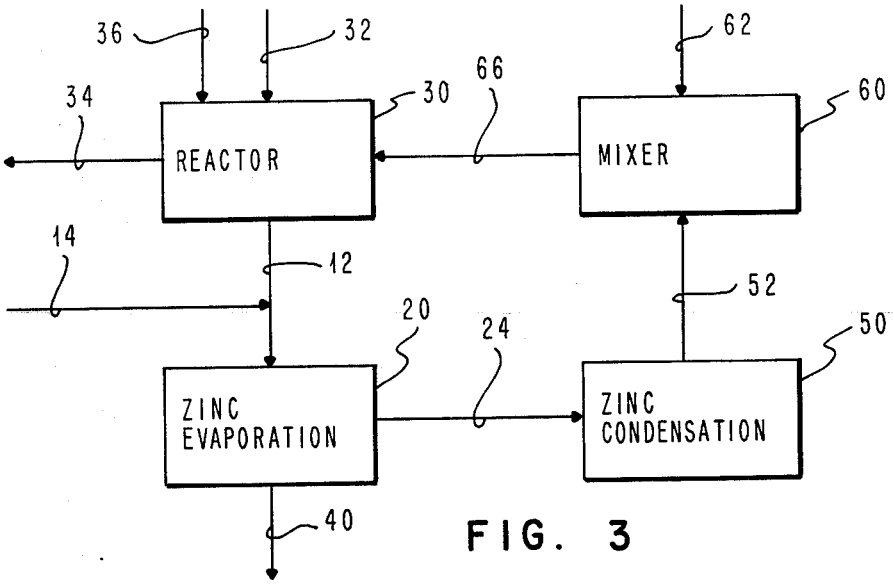
FIG. 3 is a schematic diagram of an embodiment of the present invention for the production of sponge titanium or sponge titanium alloy from titanium tetrachloride.

In FIG. 3, a reactor 30 is shown for the reaction of titanium tetrachloride with a mixture of zinc and a reducing metal. Suitable reducing metals are selected from the group consisting of sodium, megnesium, potassium, lithium, calcium, and mixtures thereof, with sodium and magnesium being preferred. Of these, magnesium is preferred. In the following discussion of the Figures, the reducing metal will be referred to as magnesium for convenience, although the invention is not so limited. Typically, the magnesium is present in the liquid zinc-magnesium mixture in an amount from about 8 to about 15 wt %. The preferred range will be determined by a variety of factors which will be discussed subsequently. A liquid mixture of zinc and magnesium is charged to reactor 30 through line 66 and reacted in reactor 30 with a stream of titanium tetrachloride charged to reactor 30 through a line 32. Desirably, the titanium tetrachloride is vaporized, charged to reactor 30 in its gaseous phase, and bubbled into reactor 30 beneath the surface of the liquid mixture. Desirably, an inert gas, such as argon, helium, or the like, is used to maintain an inert atmosphere in reactor 30. In reactor 30, titanium tetrachloride is supplied in an amount substantially stoichiometrically equal to the amount of magnesium contained in the liquid zinc-magnesium mixture. Since the reaction is relatively complete and relatively rapid, desirably little magnesium or titanium tetrachloride remain in the reaction mixture after reaction to produce a liquid mixture of titanium and zinc and a liquid magnesium chloride stream. The magnesium chloride stream is immiscible with and less dense than the liquid mixture of titanium and zinc and is readily separated and recovered through a line 34 by gravimetric separation. The resulting liquid zinc-titanium mixture is recovered through a line 12 and passed to a zinc evaporation zone 20, where zinc is evaporated to produce sponge titanium. The vaporous zinc is recovered through a line 24 and passed to a zinc condensation zone 50, where it is condensed to produce zinc for recycle via a line 52 to a mixer 60, where it is mixed with additional quantities of magnesium to produce the mixture of zinc and magnesium charged to reactor 30 through line 66. The sponge titanium is recovered through a line 40. Titanium alloys may be produced by the addition of alloying metal through line 14.

The operating temperatures in reactor 30 are desirably from about 600° to about 1000° C. Preferably the temperature range is from about 800° to about 900° C. At the preferred temperatures, the solubility of titanium in zinc is from about 10 to about 15 wt % based on the weight of the mixture. The production of such quantities of titanium in the liquid mixture of zinc and titanium requires that the liquid mixture of zinc and magnesium charged to reactor 30 contain from about 10 to about 15 wt % magnesium. Higher concentrations of titanium can be accomplished if higher temperatures are used. In the event that such is the case, magnesium concentrations as high about as 25 wt % may be desirable in the stream in line 66. However, the use of such higher temperatures results in several disadvantages. Elevated pressures must be used at temperatures above about 925° C. because of the high vapor pressure of zinc. The heat requirements for the process are substantially greater. The titanium begins to react with many materials used in the fabrication of process vessels at temperatures, above about 1050° C. As a result, temperatures below about 925° C. are preferred.

Desirably, the temperatures in the zinc evaporation zone are from about 800° to about 1000° C. Residence times are selected to remove at least a major portion of the zinc and will vary widely based upon the evaporative process selected, as known to those skilled in the art. Residual quantities of magnesium, which may be contained in the zinc-titanium mixture charged to zinc evaporation zone 20, may also be sublimed or evaporated from the titanium sponge at such temperatures.

Figure 4:
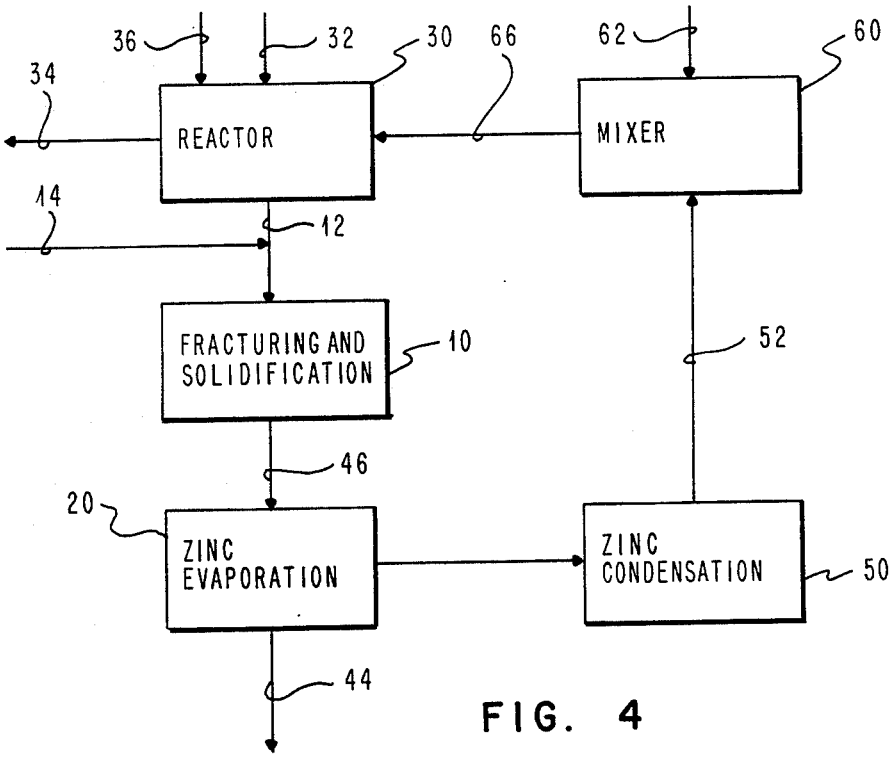
FIG. 4 is a schematic diagram of an embodiment of the present invention for the production of titanium or titanium alloys in finely divided particulate form from titanium tetrachloride.

In FIG. 4, a similar process is shown except that a fracturing and solidification zone 10 is used prior to the zinc evaporation zone 20. As a result, the products recovered through line 44 are finely divided particulate titanium or titanium alloys. The production of finely divided titanium metal is accomplished, as discussed in conjunction with FIG. 3, with a liquid zinc-titanium mixture being recovered through line 12 and passed to fracturing and solidification zone 10. Similarly, a liquid zinc-titanium-alloying metal mixture may be passed to fracturing and solidification zone 10 by adding alloying metals to the liquid zinc-titanium mixture in line 12 through a line 14. In both instances, the downstream processing is as discussed previously in conjunction with FIGS. 1 and 2. Further, it may be desirable in some instances to reduce internal porosity and shrink the resulting particulate titanium or titanium alloy. Such shrinkage is accomplished by heating the titanium or titanium alloy particulates in vacuum to a temperature from about 900° to about 1200° C., for a time from about one-half to about 12 hours. The heat shrinkage serves to reduce the surface area of the finely divided particulate solids, which is desirable in some powder metallurgy and other applications.

In a variation of the processes shown in FIG. 3 and FIG. 4, the alloying metal or metals may be added through line 36 to reactor 30 in the form of alloying metal chlorides. Such metal chlorides are added in an amount sufficient to produce a titanium alloy of the desired composition. Clearly the use of such metal chlorides will require a corresponding adjustment in the amount of magnesium contained in the liquid mixture charged through line 66. Such alloying metal additions may be used in addition to or in lieu of the addition of alloying metals through line 14.

One important advantage accomplished in the practice of the present invention is the removal of residual chlorine or chlorides from the liquid mixture charged to either zinc evaporation zone 20 or fracturing and solidification zone 10. The presence of such chloride materials is effectively prevented by the immiscibility of the metal and chloride liquids and, as a result, chlorine contamination of the products produced by the process discussed above is not a serious consideration.

Further, in the practice of the present invention, it is to be noted that most handling of the titanium bearing streams is accomplished with the titanium in mixture with liquid or solid zinc. As a result, while it is still desirable that the process steps be conducted in an inert atmosphere, the resulting safety considerations and process control considerations are less severe than when pure titanium is handled. As well-known to those skilled in the art, it is difficult to handle pure titanium in such environments without the production of titanium oxide or other titanium compounds. Such is, of course, highly undesirable when it is desired to produce relatively pure titanium metal or titanium metal alloy products. As a result of the association of the titanium with the zinc, the process operates at much lower temperatures than were molten titanium handled alone. The liquid mixture of zinc and titanium and the mixture of zinc, titanium and alloying metal in line 12 are at temperatures substantially below the melting point of titanium and generally near the temperature in reactor 30. As indicated previously, the safety and purity considerations as a result of the extremely high chemical activity of titanium are reduced. Such advantages are not accomplished in processes which require the handling of titanium in its pure form.

Having thus described the invention by reference to its preferred embodiments, it is pointed out that the embodiments described are illustrative rather than limiting in nature, and that many variations and modifications are possible within the scope of the present invention. Many such variations and modifications may be considered obvious and desirable by those skilled in the art based upon a review of the foregoing description of preferred embodiments.

Having thus described the invention, we claim:

1. A process for producing finely divided particles of titanium, said process comprising:

(a) forming a liquid mixture of titanium and zinc;

(b) fracturing and solidifying said liquid mixture of titanium and zinc by inert gas atomization to produce finely divided particles of said mixture;

(c) evaporatively separating said zinc from said finely divided particles of said mixture to produce said finely divided particles of titanium.

2. The process of claim 1 wherein said finely divided particles of said mixture are comminuted to a desired particle size.

3. The process of claim 1 wherein said finely divided particles of titanium are heated in vacuum to reduce the surface area of said titanium.

4. The process of claim 1 wherein said liquid mixture of titanium and zinc is produced by reacting a liquid mixture of zinc and a reducing metal selected from the group consisting of sodium, magnesium, potassium, lithium, calcium, and mixtures thereof, with titanium tetrachloride to produce reducing metal chloride and said liquid mixture of titanium and zinc.

5. The process of claim 4 wherein said reducing metal chloride is separated from said liquid mixture of titanium and zinc.

6. A process for producing finely divided particles of a titanium alloy, said process comprising:

(a) forming a liquid mixture of titanium, at least one alloying metal and zinc, said titanium and said alloying metal being present in selected alloying proportions;

(b) fracturing and solidifyng said liquid mixture of titanium, alloying metal and zinc by inert gas atomization to produce finely divided particles of said mixture; and (c) evaporatively separating said zinc from said finely divided particles of said mixture to produce said finely divided particles of titanium alloy.

7. The process of claim 6 wherein said finely divided particles of said mixture are comminuted to a desired particle size.

8. The process of claim 6 wherein said alloying metal is selected from the group consisting of vanadium, aluminum, molybdenum, tin, chromium, zirconium, columbium, tantalum, iron, and mixtures thereof.

9. The process of claim 6 wherein said alloying metals are vanadium and aluminum.

10. The process of claim 9 wherein said vanadium and said aluminum are present in amounts sufficient to produce a titanum alloy containing from about 1 to 15 wt % vanadium and from about 1 to about 15 wt % aluminum.

11. The process of claim 6 wherein said finely divided particles of titanium alloy are heated in vacuum to reduce the surface area of said titanium alloy.

12. The process of claim 6 wherein said liquid mixture of titanium, alloying metal and zinc is formed by admixing said alloying metal with a liquid mixture of titanium and zinc at a temperature sufficient to produce said liquid mixture of titanium, alloying metal and zinc.

13. The process of claim 12 wherein said liquid mixture of titanium and zinc is produced by reacting a mixture of zinc and a reducing metal selected from the group consisting of sodium, magnesium, potassium, lithium, calcium, and mixtures thereof, with titanium tetrachloride to produce reducing metal chloride and said liquid mixture of titanium and zinc.

14. The process of claim 13 wherein said reducing chloride is separated from said liquid mixture of titanium and zinc.

15. The process of claim 6 wherein said liquid mixture of titanium, alloying metal and zinc is formed by reacting a mixture of zinc and a reducing metal selected from the group consisting of sodium, magnesium, potassium, lithium, calcium, and mixtures thereof, with titanium tetrachloride and alloying metal chlorides to produce reducing metal chloride and said liquid mixture of titanium, alloying metal and zinc.

16. A process for producing titanium from titanium tetrachloride, said process comprising:

(a) Reacting a liquid mixture of zinc and a reducing metal selected from the group consisting of sodium, magnesium, potassium, lithium, calcium, and mixtures thereof, with vaporized titanium tetrachloride at a temperature between about 650° C. and about 1000° C. to produce reducing metal chloride and a liquid mixture of titanium and zinc, said vaporized titanium tetrachloride being injected into said liquid zinc-reducing metal mixture beneath the surface of said liquid zinc-reducing metal mixture;

(b) Separating at least a major portion of said reducing metal chloride from said liquid mixture of titanium and zinc; and (c) Solidifying and fracturing said liquid mixture of titanium and zinc to produce particles thereof; and (d) Evaporatively separating said zinc from said particles of the mixture of titanium and zinc to produce titanium metal particles.

17. A process for producing titanium from titanium tetrachloride, said process comprising:

(a) Reacting a liquid mixture of zinc and a reducing metal selected from the group consisting of sodium, magnesium, potassium, lithium, calcium, and mixtures thereof, with vaporized titanium tetrachloride at a temperature between about 650° and about 1000° C. to produce reducing metal chloride and a liquid mixture of titanium and zinc, said vaporized titanium tetrachloride being injected into said liquid zinc-reducing metal mixture beneath the surface of said liquid zinc-reducing metal mixture;

(b) Separating at least a major portion of said reducing metal chloride from said liquid mixture of titanium and zinc; and (c) Fracturing and solidifying the liquid zinc-titanium mixture by inert gas atomization to produce particles of the zinc-titanium mixture; and (d) Evaporatively separating said zinc from said particles of the zinc-titanium mixture to produce titanium metal particles.

18. A process for producing titanium from titanium tetrachloride, said process comprising:

(a) Reacting a liquid mixture of zinc and a reducing metal selected from the group consisting of sodium, magnesium, potassium, lithium, calcium, and mixtures thereof, with vaporized titanium tetrachloride at a temperature between about 650° and about 1000° C. to produce reducing metal chloride and a liquid mixture of titanium and zinc, said vaporized titanium tetrachloride being injected into said liquid zinc-reducing metal mixture beneath the surface of said liquid zinc-reducing metal mixture;

(b) Separating at least a major portion of said reducing metal chloride from said liquid mixture of titanium and zinc; and (c) Fracturing and cooling said liquid zinc-titanium mixture by shotting to produce particles of the zinc-titanium mixture; and (d) Evaporatively separating said zinc from said particles of the zinc-titanium mixture to produce titanium metal particles.

19. A process for producing titanium from titanium tetrachloride, said process comprising:

(a) Reacting a liquid mixture of zinc and a reducing metal selected from the group consisting of sodium, magnesium, potassium, lithium, calcium, and mixtures thereof, with vaporized titanium tetrachloride at a temperature between about 650° and about 1000° C. to produce reducing metal chloride and a liquid mixture of titanium and zinc, said vaporized titanium tetrachloride being injected into said liquid zinc-reducing metal mixtures beneath the surface of said liquid zinc-reducing metal mixture;

(b) Separating at least a major portion of said reducing metal chloride from said liquid mixture of titanium and zinc; and (c) Solidifying and fracturing said liquid zinc-titanium mixture to produce particles of the zinc-titanium mixture;

(d) Comminuting said particles of the zinc-titanium mixture to produce comminuted particles of the zinc-titanium mixture of a desired size; and (e) Evaporatively separating said zinc from said comminuted particles of the zinc-titanium mixture to produce titanium metal particles of a desired size.

20. A process for producing a titanium alloy from titanium tetrachloride, said process comprising:

(a) Reacting a liquid mixture of zinc and a reducing metal selected from the group consisting of sodium, magnesium, potassium, lithium, calcium, and mixtures thereof, with vaporized titanium tetrachloride at a temperature between about 650° C. and about 1000° C. to produce reducing metal chloride and a liquid mixture of titanium and zinc, said vaporized titanium tetrachloride being injected into said liquid zinc-reducing metal mixture beneath the surface of said liquid zinc-reducing metal mixture;

(b) Separating at least a major portion of said reducing metal chloride from said liquid mixture of titanium and zinc;

(c) Adding at least one alloying metal to said liquid mixture of titanium and zinc to form a liquid mixture of alloying metal, titanium and said zinc; and (d) Evaporatively separating said zinc from said titanium and alloying metal to produce said titanium alloy.

21. The process of claim 20 wherein said alloying metal is selected from the group consisting of vanadium, aluminum, molybdenum, tin, chromium, zirconium, columbium, tantalum, iron, and mixtures thereof.

22. The process of claim 21 wherein said alloying metal is a mixture of vanadium and aluminum.

23. The process of claim 22 wherein said vanadium and said aluminum are present in amounts sufficient to produce a titanium alloy containing from about 1 to about 15 wt % vanadium and from about 1 to about 15 wt % aluminum.

24. The process of claim 20 wherein said reducing metal is magnesium or sodium.

25. The process of claim 24 wherein said reducing metal is magnesium.

26. The process of claim 20 wherein said liquid mixture of alloying metal, titanium and zinc is fractured and solidified by inert gas atomization to produce finely divided particles of said mixture prior to separation of said zinc.

27. The process of claim 26 wherein said liquid mixture of alloying metal, titanium and zinc is fractured and solidified by shotting said liquid mixture to produce finely divided particles of said mixture prior to separation of said zinc.

28. The process of claim 20 wherein said finely divided particles of said mixture are comminuted to a desired particle size.

29. The process of claim 20 wherein said liquid mixture of alloying metal, titanium and zinc is solidified and thereafter comminuted to a desired particle size prior to separation of said zinc.

30. A process for producing a titanium alloy from titanium tetrachloride, said process comprising:

(a) Reacting a liquid mixture of zinc and a reducing metal selected from the group consisting of sodium, magnesium, potassium, lithium, calcium, and mixtures thereof, with a mixture of titanium tetrachloride and at least one alloying metal chloride to produce reducing metal chloride and a liquid mixture of titanium, alloying metal and zinc;

(b) Separating at least a major portion of said reducing metal chloride from said liquid mixture of titanium, alloying metal and zinc; and (c) Evaporatively separating said zinc from said titanium and said alloying metal to produce said titanium alloy.

31. The process of claim 30 wherein said reducing metal is magnesium or sodium.

32. The process of claim 31 wherein said reducing metal is magnesium.

33. The process of claim 30 wherein said alloying metal is selected from the group consisting of vanadium, aluminum, molybdenum, tin, chromium, zirconium, columbium, tantalum, iron, and mixtures thereof.

34. The process of claim 33 wherein said alloying metal is a mixture of vanadium and aluminum.

35. The process of claim 31 wherein said vanadium chloride and said aluminum chloride are added in amounts sufficient to produce a titanium alloy containing from about 1 to about 15 wt % vanadium and from about 1 to about 15 wt % aluminum.

36. The process of claim 30 wherein said liquid mixture of alloying metal, titanium and zinc is fractured and solidified by inert gas atomization to produce finely divided particles of said mixture prior to separation of said zinc.

37. The process of claim 30 wherein said liquid mixture of alloying metal, titanium and zinc is fractured and solidified by shotting said liquid mixture to produce finely divided particles of said mixture prior to separation of said zinc.

38. The process of claim 30 wherein said finely divided particles of said mixture are comminuted to a desired particle size.

39. The process of claim 38 wherein said liquid mixture of alloying metal, titanium and zinc is solidified and thereafter comminuted to a desired particle size.

* * * * *